US010595594B2

(12) United States Patent
Masserini

(10) Patent No.: US 10,595,594 B2
(45) Date of Patent: Mar. 24, 2020

(54) RAPID RELEASE DEVICE FOR WEARABLE ARTICLES

(71) Applicant: DUE EMME S.R.L., Cinisello Balsamo (Milan) (IT)

(72) Inventor: Angelo Andrea Masserini, Milan (IT)

(73) Assignee: DUE EMME S.R.L., Cinisello Balsamo (IT)

( * ) Notice: Subject to any disclaimer, the term of this patent is extended or adjusted under 35 U.S.C. 154(b) by 53 days.

(21) Appl. No.: 15/958,030

(22) Filed: Apr. 20, 2018

(65) Prior Publication Data

US 2018/0310673 A1 Nov. 1, 2018

(30) Foreign Application Priority Data

Apr. 27, 2017 (IT) ..... 102017000045764

(51) Int. Cl.
*A44B 11/25* (2006.01)
*F41H 1/02* (2006.01)

(52) U.S. Cl.
CPC ..... *A44B 11/2592* (2013.01); *A44B 11/2596* (2013.01); *F41H 1/02* (2013.01); *A44D 2200/10* (2013.01)

(58) Field of Classification Search
CPC ... A44B 11/2592; A44B 11/2596; F41H 1/02; A44D 2200/10; Y10T 24/45995; A41F 1/006; A41F 1/008; Y10S 24/38; Y10S 24/43; A44C 5/2066
See application file for complete search history.

(56) References Cited

U.S. PATENT DOCUMENTS 796,414 A * 8/1905 Chayes ..... A41F 3/02 24/319
1,920,408 A * 8/1933 Lafayette ..... B64D 17/30 24/654
2,956,324 A * 10/1960 Ann Klein ..... A44B 11/2596 24/323
3,979,801 A 9/1976 Tareau
(Continued)

FOREIGN PATENT DOCUMENTS

WO 2013119294 A1 8/2013

*Primary Examiner* — Robert Sandy
*Assistant Examiner* — Rowland Do
(74) *Attorney, Agent, or Firm* — Pearne & Gordon LLP

(57) ABSTRACT

A rapid release device (1) for wearable articles (2) comprising: a first body (3) having a portion (3*a*) for coupling to a first part (2*a*) of said article (2) and defining at least one through cavity (6); a second body (4) associated with the first body (3) in a reversible manner and having a portion (4*a*) for coupling to a second part (2*b*) of said article (2) and at least one interlocking element (7) housed in said cavity (6); release means (8) obtained in said first and second body (3, 4) to allow the interlocking element (7) to slide outside of said cavity (6) and define a decoupling condition of the first body (3) from the second body (4); said interlocking element (7) and said cavity (6) slide with respect to each other along a respective direction (A) corresponding to the lateral development direction of the first and second body (3; 4); said interlocking element (7) and said cavity (6) extending along a same longitudinal axis (Y) for a dimension (D) smaller than the dimension (L) of the first and second body (3; 4) along said lateral development direction.

10 Claims, 5 Drawing Sheets

(56) References Cited

U.S. PATENT DOCUMENTS

| | | | | | |
|---|---|---|---|---|---|
| 4,578,843 | A * | 4/1986 | Lewis | A44B 11/2596 | 24/319 |
| 4,935,996 | A * | 6/1990 | Ferrara | A44B 11/2596 | 24/33 R |
| 5,671,516 | A * | 9/1997 | Sartori | A44B 11/2515 | 24/579.11 |
| 6,009,604 | A * | 1/2000 | Fildan | A41F 1/006 | 24/318 |
| 2010/0263171 | A1 * | 10/2010 | Paik | A44B 11/25 | 24/194 |
| 2014/0332572 | A1 | 11/2014 | Buerck et al. | | |
| 2014/0341639 | A1 | 11/2014 | Iannello et al. | | |

* cited by examiner

RAPID RELEASE DEVICE FOR WEARABLE ARTICLES

The present invention refers to a rapid release device for wearable articles.

In greater detail, the present invention refers to a rapid release device for articles such as clothing, backpacks, belts or any other type of article which, in case of need, must be unhooked and removed from the user's body in a simple and immediate manner.

For example, in the case of bullet-proof vests, it is necessary to provide a system for the immediate removal of the vest from the user's body, which can be carried out under urgent conditions due to a partial inability of the user's movement.

In fact, especially in the context of the use of the article for military purposes, the user in injured or semi-immobility conditions must still be able to unhook the bullet-proof vest (or backpack or any other type of belt worn by the user) by separating respective portions of the vest between each other and thus allowing the article to be easily removed from the body.

For this purpose, the rapid release devices are generally arranged at belts or shoulder straps adhering to the users body and easily accessible in order to allow rapid release by manual action.

As known, the rapid release devices consist of two portions, each of which is stably associated with a part of the article to be separated. The portions are reversibly engaged with each other by means of suitable mechanical coupling systems. Generally, such systems are implemented by interlocking surfaces suitably configured to couple and resist traction actions under normal use conditions.

At least one of the two portions is also provided with a manual actuator in the form of a tab or cord, adapted to be pulled along a direction transverse to the coupling/uncoupling direction of the two portions.

In this way, by acting on the actuator, the mechanical interlock of the two portions is released, allowing their separation and the consequent possibility of dissociating the article from the users body.

An example of the known systems described above is illustrated in the International patent application no. WO 2013/119294, which describes a rapid release device in particular for bullet-proof vests able to dissociate some components of the vest from the users body (front portion, rear portion, side portions).

This device consists of a first portion provided with a longitudinal cavity configured in a substantially C-shaped cross-section. The cavity therefore defines an access opening interposed between two ends having respective internal contrasting surfaces.

The device also provides a second portion provided with a projecting element that can be inserted into the longitudinal cavity. For this purpose, the protruding portion is substantially counter-shaped to the cavity and has an undercut that can be coupled to the contrasting surfaces. This coupling defines a stable engagement of the two portions, which ensures a tensile strength when the portions themselves are away from each other.

The first portion also has a pulling tab suitable for elastically deforming at least one of the two ends defining the "C" cavity to dissociate a contrasting surface from the respective undercut. In this situation, the two portions are free to slide along the longitudinal development of the cavity in order to remove the protruding element from the cavity itself.

Therefore, in the event of a rapid release, the user first acts by lifting the tab by means of manual traction and, at the same time, slides the two portions in a relative manner along a direction corresponding to the longitudinal development of the cavity until the protruding element is completely disconnected from the cavity itself.

This device, although capable of unhooking portions of the vest without having to completely remove it from the head, nevertheless has important drawbacks and limitations in application.

First of all, it should be considered that the manual action of decoupling the two portions turns is particularly inconvenient as it involves the simultaneous action of raising (deforming) the tab and of sliding the two portions. This involves the engagement of both hands of the user who, while pulling the tab, realizes the relative sliding of the portions by the other hand.

In this context, especially in the case of immobility of a limb, it is particularly problematic to provide the rapid release of the vest using only one hand, which, at the same time, must pull the tab and, while maintaining the deformation of the tab, slide the portions.

Furthermore, it should be considered that the need to free both hands to unhook the device can be problematic and not always possible, for example in the case where the user must hold a firearm.

A further important drawback of the known devices described above is due to the release movement of the two portions, which must slide relatively along the whole longitudinal development of the "C" cavity, and which therefore must perform a very long stroke before they can be detached. In this context it should be noted that the length of the cavity is sized according to the various applications of the device and therefore can be greatly extended in the case of coupling of large portions of the vest. In this context, the relative sliding of the two portions entails considerable drawbacks in terms of speed of implementation of the release operations. In addition to the above, it should be considered that the release times of the device are multiplied by the number of devices that need to be unhooked in order to remove the vest or a wearable article.

Finally, another important drawback of the known devices described above is due to the structure of the cavity which, being configured as "C", has an access opening through which the protruding element can pass.

In fact, in the case of very high tensile forces, which tend to move the two portions away, the mechanical interlock defined between the undercut and the contrasting surface may not be sufficient to constrain the element inside the cavity. In this context, the element tends to slide out of the cavity through the opening and thus causes an accidental detachment of the device, resulting in disadvantages in terms of safety and strength of the device itself.

The object of the present invention is therefore to provide a rapid release device for wearable articles which is capable of solving the above-mentioned problems.

In particular, an object of the present invention is to provide a rapid release device, which is able to make the decoupling operation of the portions which make up the device more simple and immediate, and which allow the respective article to be removed from the body user.

In greater detail, it is an object of the present invention to provide a rapid release device which allows the release action by a single hand and with a limited gesture in terms of time and amplitude.

Furthermore, it is an object of the present invention to provide a particularly safe rapid release device, which is able to withstand very high stresses due to the traction of the two portions that make up the device. Finally, the present invention also aims at providing a rapid release device, usable for any type of wearable article, and which is structurally simple and inexpensive.

The technical task mentioned and the objects stated are substantially achieved by a rapid release device for wearable articles comprising the technical features set out in one or more of the appended claims.

Further characteristics and advantages of the present invention will become more apparent from the description of a exemplary, but not exclusive, and therefore non-limiting preferred embodiment of a rapid release device, as illustrated in the appended drawings, in which.

With reference to the accompanying figures, with 1 a rapid release device is generally indicated.

Figure 7:
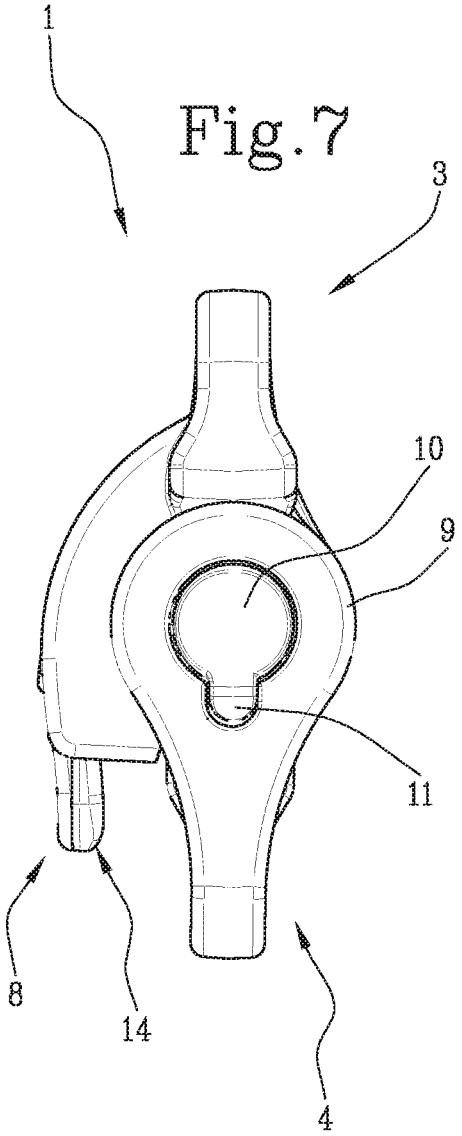
FIG. 7 shows a side elevation view of the rapid release device according to the present invention.
Figure 8:
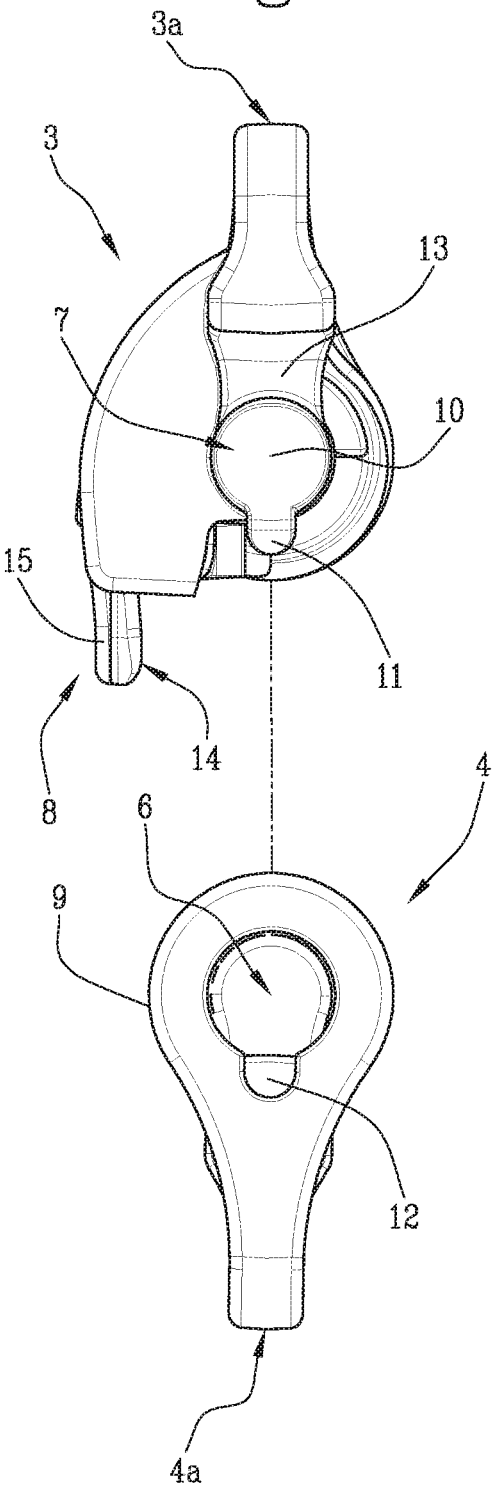
FIG. 8 shows a side elevation view of the first and second portion of the device shown in FIGS. 5 and 6.
Figure 9:
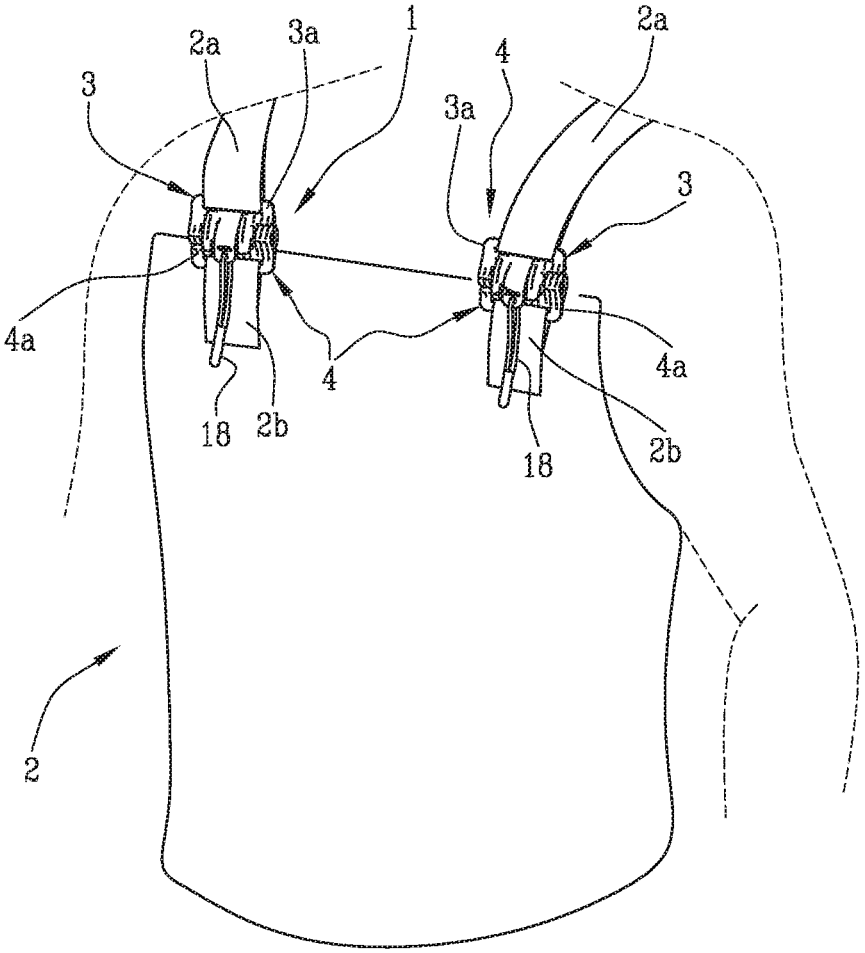
FIG. 9 shows a perspective and schematic view of a wearable article provided with a pair of rapid release devices according to the present invention.

In particular, the device 1 finds particular application for wearable articles 2 such as, for example, bullet-proof vests, backpacks, belts, connecting belts or any other element that is dressed and worn to the body of a user. For this purpose, in FIG. 7, a wearable article 2 in the form of a bullet-proof vest worn by a user is illustrated purely by way of non-limiting example. In this case, two rapid release devices 1 are provided, arranged respectively at the shoulder straps of the vest 2 in order to allow a rapid removal of the vest without having to remove it from the head.

It should however be specified that the device 1 can be arranged in any area of article 2 according to the type of article 2 itself and according to the various application requirements.

In particular, the device 1 comprises a first body 3 having a coupling portion 3*a* to a first part 2*a* of the article 2 such as, for example, a belt. Preferably, the coupling portion 3*a* has a substantially rectangular shape and internally defines a slot 5 adapted to receive the aforementioned first part 2*a* (belt) of the article 2.

The device 1 further comprises a second body 4 having a coupling portion 4*a* to a second part 2*b* of the article 2 such as, for example, a belt. The two bodies 3, 4 are substantially the same, as the coupling portion 4*a* of the second body 4 has also a substantially rectangular conformation and internally defines a slot 5 adapted to receive the aforementioned second part 2*b* (belt) of the article 2.

Figure 5:
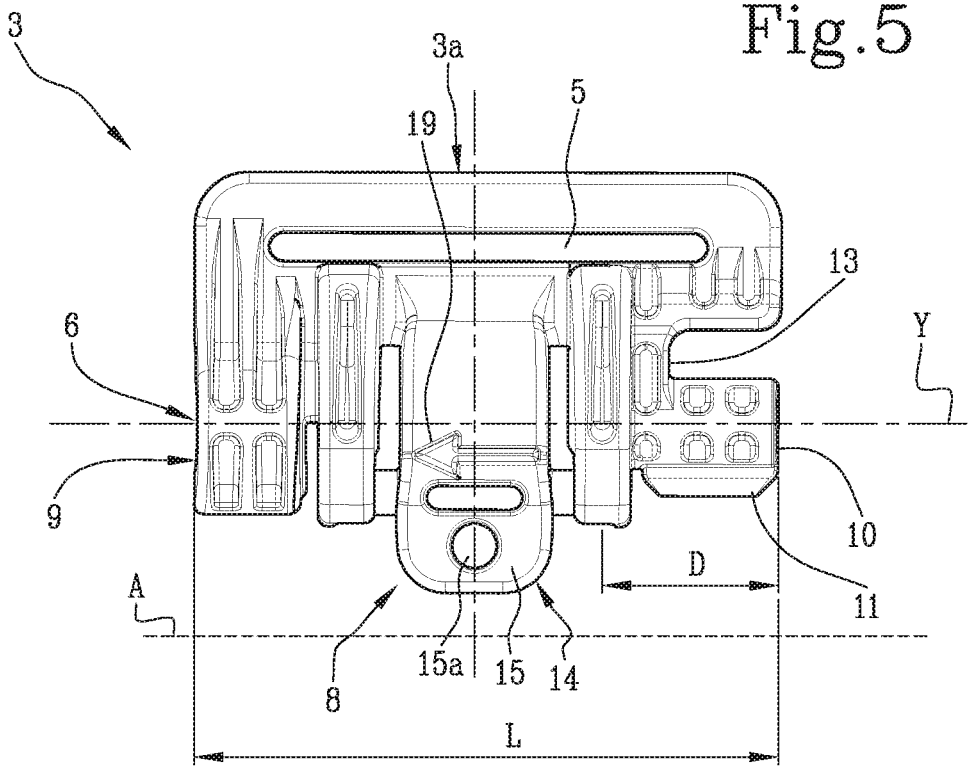
FIG. 5 shows a front elevation view of a first portion of the device according to the present invention.
Figure 6:
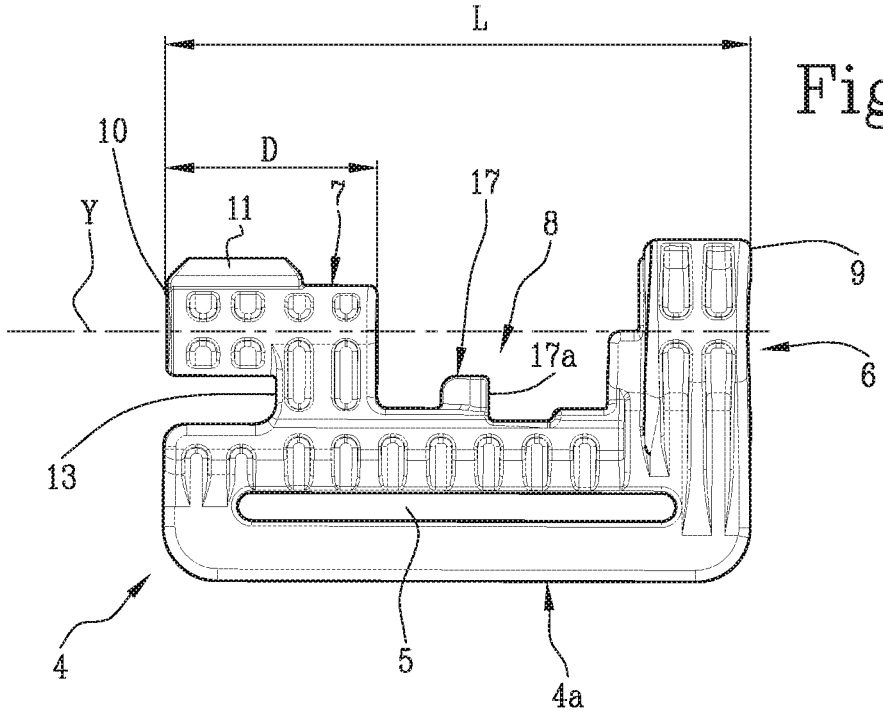
FIG. 6 shows a front elevation view of a second portion of the device according to the present invention.

The first and second bodies 3, 4 have the same dimensions and are laterally extending along a same lateral development direction for a dimension "L" corresponding to the major side of said substantially rectangular shape (FIGS. 5 and 6).

The first body 3 further comprises at least a through cavity 6 configured to house an interlocking element 7 arranged in said second body 4.

In this situation, the two bodies 3, 4 are associated with each other in a reversible manner.

In fact, the device 1 further comprises release means 8 formed both in the first and in the second body 3, 4 to allow the interlocking element 7 to slide out of the cavity 6 and to define a decoupling condition (FIGS. 3 and 4) of the first body 3 from the second body 4.

said interlocking element (7) and said cavity (6) slide with respect to each other along a respective direction (A) corresponding to the lateral development direction of the first and second body (3, 4);

Always referring to FIG. 5 and FIG. 6, it is noted that the interlocking element 7 and the cavity 6 extend along a same longitudinal development axis "Y" for a respective dimension "D" lower than the dimension "L" of the first and second body 3, 4.

In greater detail, the aforementioned cavity 6 is formed in an annular projection 9 extending from the coupling portion 3*a* of the first body 3 and having a substantially circular conformation in transversal cross-section, coaxial with the longitudinal axis Y.

Likewise, the interlocking element 7 comprises a cylindrical projection 10 extending from the coupling portion 4*a* of the second body 4 and having a substantially circular conformation in transversal cross-section, coaxial with the longitudinal axis Y.

In this situation, the development of the cylindrical projection 10 is counter-shaped to the internal shape of the annular projection 9. It should also be noted that the annular projection 9, by virtue of its conformation, is capable of allowing the passage of the interlocking element 7 only along the aforementioned direction "A" thus avoiding any decoupling as a result of transverse stresses to the longitudinal development axis "Y".

The cylindrical projection 10 also has a locking crest 11 protruding from the cylindrical outer surface of the projection 10 itself, and housable at a recessed area 12 formed in the annular internal surface of the projection 9.

In this situation, the ridge 11 is housed inside the zone 12 to block the possible rotation of the cylindrical projection inside the cavity 6 and around the axis "Y".

Advantageously, the two bodies 3, 4 are engaged and constrained in position between each other.

The interlocking element 7 also has an abutment portion 13 (better seen in FIGS. 4 and 6), which connects the cylindrical projection 10 to the connecting portion 4*a* of the second body 4.

This abutment portion 13 defines a limit stop of the annular projection 9 on the cylindrical projection 10. In other words, the abutment portion 13 allows the sliding of the annular projection 9 in a single direction of the direction "A" in order to detach the first body 3 from the second body 4. Advantageously, it should be noted from the accompanying figures that the aforementioned development longitudinal axis Y of the annular projection 9 and of the cylindrical projection 10 corresponds to the sliding direction "A" and then to the lateral development direction of the first and second bodies 3, 4.

Figure 3:
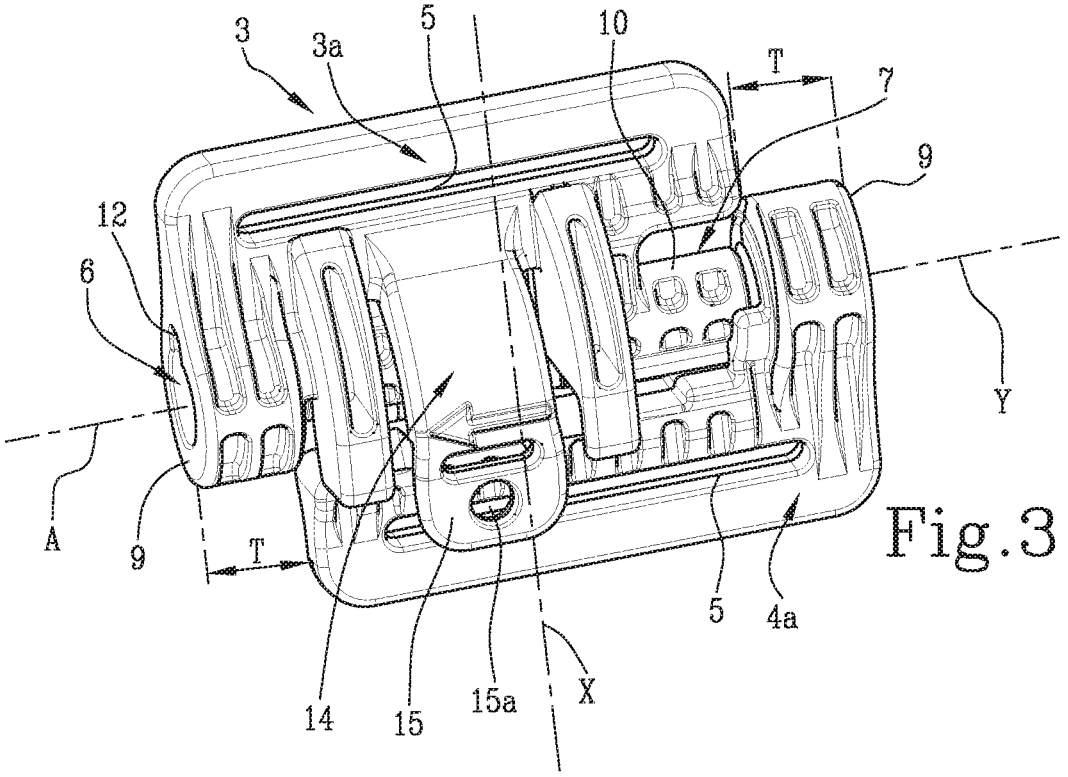
FIGS. 3 and 4 show perspective and front views of the device of FIGS. 1 and 2 in respective release sequences of the device itself.
Figure 4:
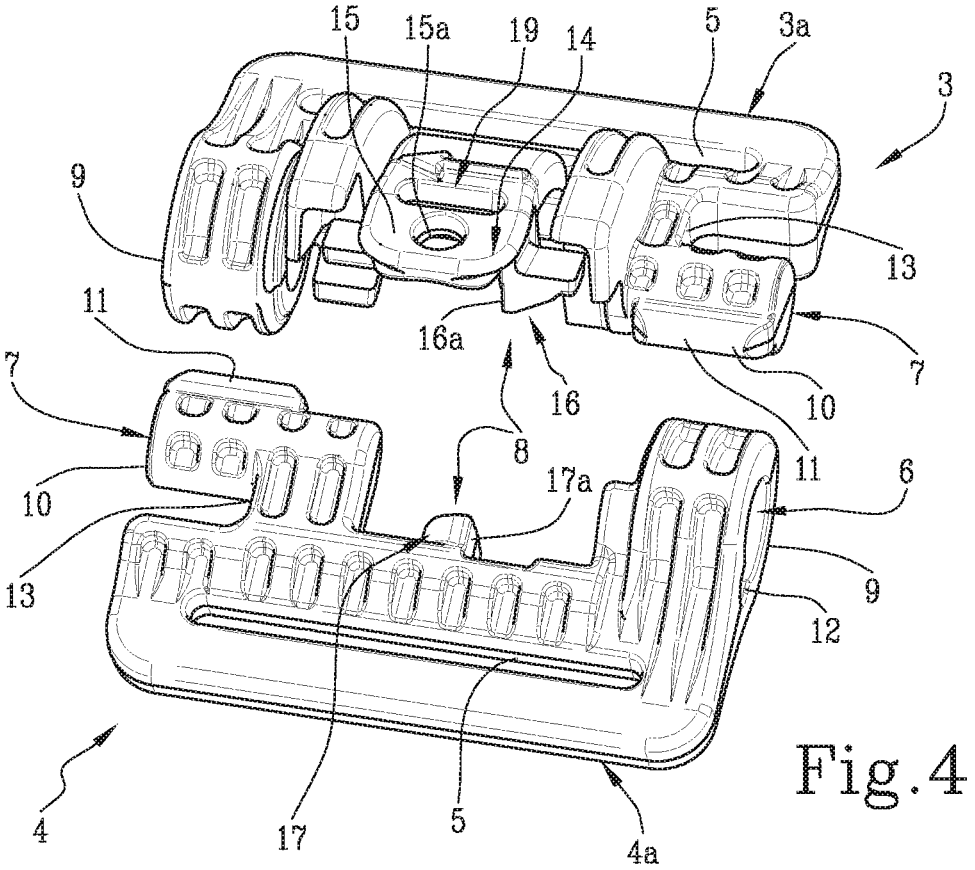

Therefore, the relative sliding between annular projection 9 and cylindrical projection 10 is carried out by making the two bodies 3, 4 move laterally to each other (FIG. 3).

Preferably, according to a preferred embodiment of the present invention, each body 3, 4 comprises both the through cavity 6 and the interlocking element 7, respectively spaced and arranged on opposite sides with respect to the lateral development direction of the body 3, 4 itself.

In this situation, as shown in FIGS. 5 and 6, the two bodies 3, 4 have the respective annular protrusions 9 and cylindrical 10 in an opposite manner. Advantageously, in this way each annular projection 9 of a respective body 3, 4 is fitted on a cylindrical projection 10 of the other body 3, 4. Moreover, in this situation it should be noted that the dimensions "D" of the interlocking element 7 (cylindrical projection 10) and of the cavity 6 (annular projection 9) of a single body 3, 4 added together are in any case smaller than the dimension "L" of the body 3, 4 itself along the aforementioned lateral development direction.

In other words, the development dimensions of the projections 9, 10 are however contained in the total length of the respective body 3, 4 in order to define in the relative sliding between annular projection 9 and cylindrical projection 10 a stroke having a much smaller width with respect to the lateral dimension "L".

This entails, as will be better explained later, a very short movement of the two bodies 3, 4 in order to determine the aforementioned decoupling condition.

Figure 1:
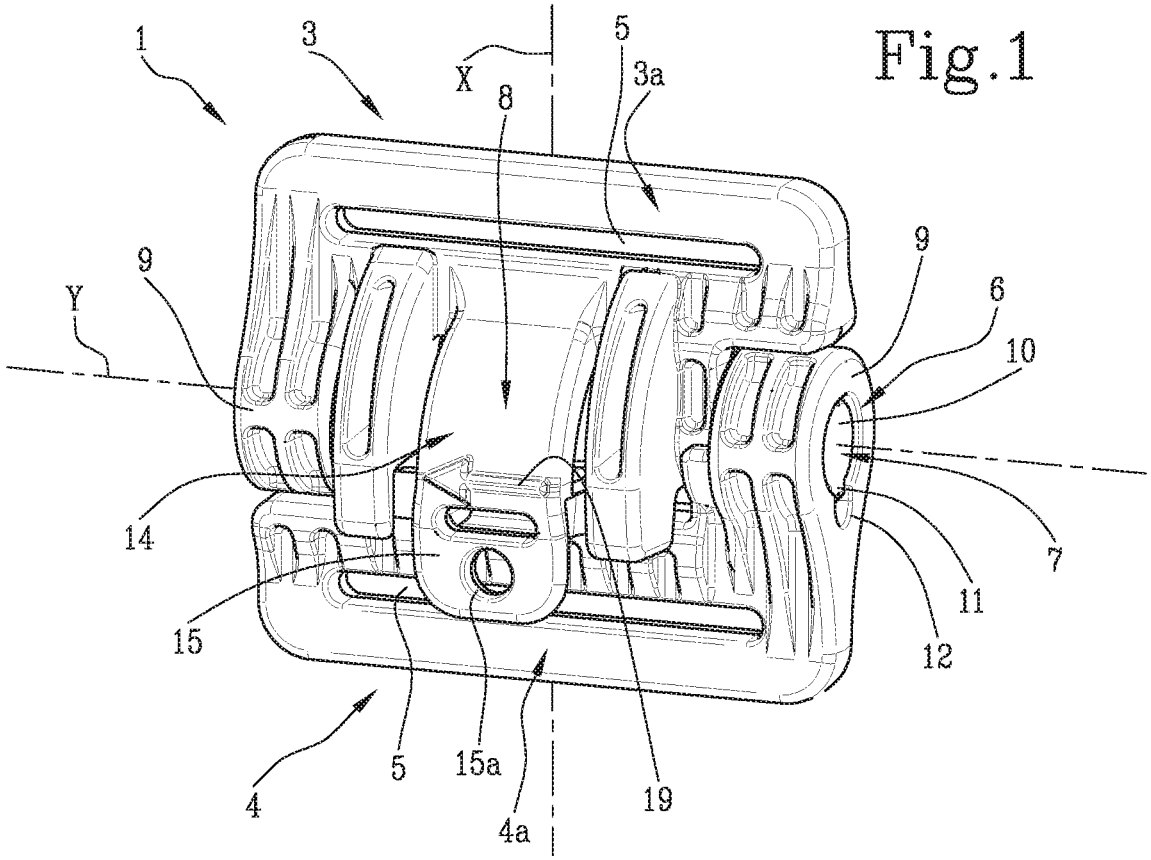
FIGS. 1 and 2 show front and rear perspective views of the rapid release device according to the present invention.

In fact, the release means 8 are switchable between a coupling condition (FIGS. 1 and 2) of the bodies 3, 4, in which the respective interlocking elements 7 are housed in the corresponding cavities 6, and the decoupling condition (FIG. 3), in which the elements 7 and the cavities 6 slide relatively on a portion "T" corresponding to the dimension "D" of each interlocking element 7.

In other words, the dimension "D" of the cylindrical projections 10 defines a stroke "T" of the two bodies 3, 4 to obtain the complete decoupling of the bodies 3, 4 which corresponds to the complete disengagement of the cylindrical projections 10 from the respective annular projections 9. Accordingly, the bodies 3, 4 in the decoupling condition are offset with respect to a transverse axis "X" perpendicular to the longitudinal axis "Y" (FIG. 3).

Figure 2:
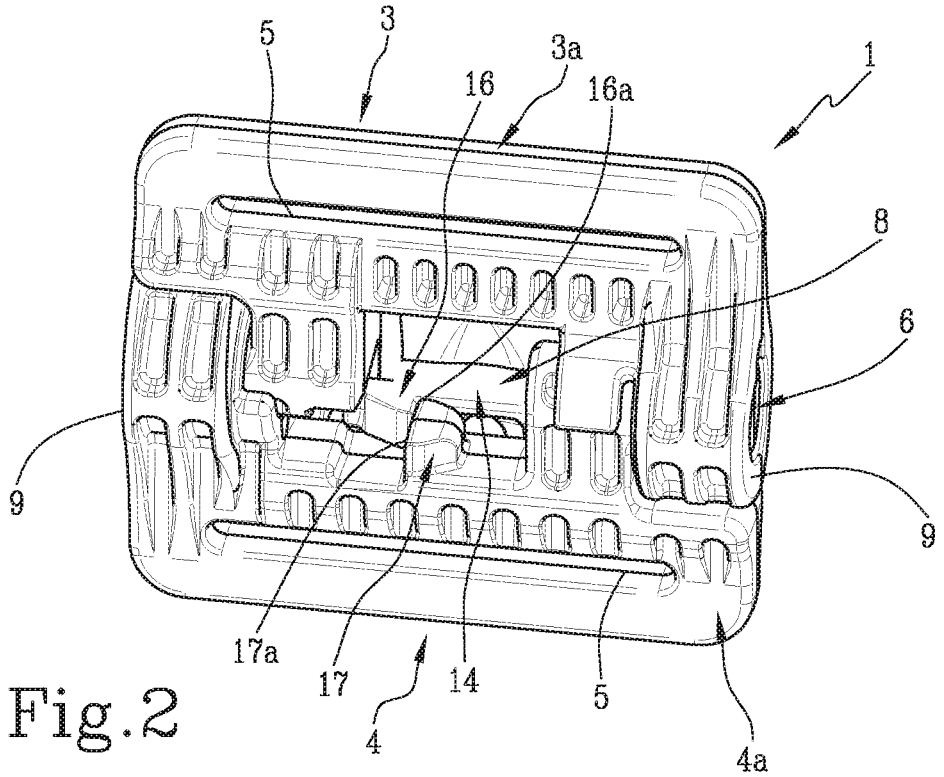

In particular, the release means 8 are constituted by an elastically deformable actuator 14 extending from the connecting portion 3*a* of the first body 3 and having a coupling portion 16 better visible in the rear view of FIG. 2.

The engagement portion 16 is in the form of a tooth defining a respective contrasting surface 16*a* lying on a plane perpendicular to the sliding direction "A".

The means 8 further comprise a gauge portion 17 extending from the connecting portion 4*a* of the second body 4 and defining a respective contrasting surface 17*a* also lying on a respective plane perpendicular to the sliding direction "A".

In this situation, the actuator 14 is movable between a first condition corresponding to the coupling condition wherein the respective contrasting surfaces 16*a*, 17*a* are mutually abutted (FIG. 2), and a second condition corresponding to the decoupling condition wherein the contrasting surface 16*a* of the connecting portion 16 is removed from the contrasting surface 17*a* of the gauge portion 17. Accordingly, in the second condition the actuator 14 disengages the engagement portion 16 from the abutment portion 17 to allow relative movement of the two bodies 3, 4 along a direction of the sliding direction "A".

Preferably, the actuator 14 comprises a tab 15 projecting from the coupling portion 3*a* and formed in one piece therewith. The tab 15 is configured to be moved by manual pulling away from the second body 4 to define the second condition in which it allows the decoupling of the two bodies 3, 4. Advantageously, to simplify the manual traction of the tab, at least one through hole 15*a* is provided on the tab 15 itself to allow the engagement of a retaining rope 18 easily gripped by the user (illustrated by way of example in FIG. 7).

The tab 15 is also interposed between the respective interlocking element 7 and the respective cavity 6 in order to be easily reachable by the user and to allow a homogeneous movement of the first body 3 and along the direction "A".

Accordingly, the abutment portion 17 is also interposed between the interlocking element 7 and the respective cavity 6 of the second body 4.

Furthermore, in order to simplify more the relative sliding action of the two bodies 3, 4, a graphic symbol 19 (arrow) is imprinted on the tab 15 to indicate the direction and direction of sliding for actuating the release action. The symbol 19 is preferably etched or obtained by moulding on the aforementioned tab 15.

The present invention described above in a predominantly structural sense also relates to a rapid release method for wearable articles 2, which comprises the steps of:

- preparing the first body 3 associated with the first part 2*a* of the article 2;
- preparing the second body 4 associated with the first body and engaged with a second part 2*b* of the article 2;
- manually activate the aforementioned release means 8; and, at the same time,
- making each interlocking element 7 slide outside the respective cavities 6 to define a decoupling condition of the first body 3 from the second body 4. The step of sliding the interlocking element 7 out of the cavity 6 is carried out by moving the first body 3 along the respective direction "A" for a portion "T" having a length shorter than the dimension "L" of the bodies 3, 4.

The step of activating the release means 8 is carried out by manually pulling the tab 15 away from the second body 4 (and from the user's body), which, when deformed, disengages the engagement portion 16 from the aforementioned abutment portion 17.

In this way, when the two contrast surfaces 16*a* and 17*a* are no longer joined but are staggered, the first body 3 is translated along the direction "A" and with respect to the second body 4.

Advantageously, both the steps of activating the release means 8 (by pulling the tab 15) and sliding the interlocking element 7 out of the cavity 6, are carried out by the same hand of the user.

In fact, once the tab 15 is gripped and pulled, it is moved towards the sliding direction "A", thus dragging the entire first body 3 sideways, which is disengaged from the second body 4 by the translating movement.

Consequently, the manual action of decoupling the two bodies 3, 4 is particularly easy since the almost simultaneous actions of traction and translation are carried out with one hand.

In this regard, it should be noted that, once the contrast surfaces 16*a*, 17*a* have been detached, it is not necessary to keep the tab 15 pulled and deformed along the entire path of the portion "T".

This condition is due to the fact that once the engagement portion 16 is raised, a small translation is sufficient to misalign the surfaces 16*a* 17*a* without the possibility that they return to a locking condition.

Moreover, the stroke path "T", which the two bodies 3, 4 must perform, is very short as determined by the aforementioned dimension "D" of the interlocking element 7. As described above, obtaining an element 7 of dimensions "D" smaller than the lateral dimension "L" of bodies 3, 4, it is possible to obtain a very short stroke, resulting in advantages in terms of convenience and very reduced times in the disengagement operations.

Moreover, despite the limited longitudinal development of the interlocking element 7 and therefore of the cavity 6, the presence of two interlocking elements 7, each on a respective body 3, 4 and arranged on the opposite side, ensures a very stable strength of the whole device 1 to the tensile stresses along the transverse axis "X".

In this context, it should also be considered that the cavity 6 is defined by an opening with a circular section, determined by the annular projection 9, which therefore excludes the possibility of an accidental disengagement of the interlocking element 7 from the cavity 6 itself.

Therefore, even in the case of very high tensile forces, which tend to move the two portions 3, 4 along the transverse axis "X", the mechanical interlock defined by the elements 7 in the respective cavities 6, ensures a stable and advantageous constrain in terms of safety and strength of the device 1 itself.

The invention claimed is:

1. A rapid release device for wearable articles comprising:

a first body (3) having a portion (3*a*) for coupling to a first part (2*a*) of said article (2) and defining at least one through cavity (6);

a second body (4) associated with the first body (3) in a reversible manner and having a portion (4*a*) for coupling to a second part (2*b*) of said article (2), and at least one interlocking element (7) housed in said cavity (6);

release means (8) obtained in said first and second bodies (3, 4) to allow the interlocking element (7) to slide outside of said cavity (6) and define a decoupling condition of the first body (3) from the second body (4); said release means (8) are switchable between a coupling condition of the bodies (3, 4) wherein the respective interlocking elements (7) are housed in the respective cavities (6), and the decoupling condition wherein the elements (7) and the cavities (6) slide with respect to each other along a respective direction (A) corresponding to a lateral development direction of the first and second bodies (3, 4) and along a section (T) corresponding to a dimension (D) of each interlocking element (7); said bodies (3, 4) in the decoupling condition being offset with respect to a transverse development axis (X) perpendicular to said longitudinal axis (Y);

said release means (8) comprising:

an elastically deformable actuator (14) extending from said first body (3) and having a connecting portion (16) defining a respective abutment surface (16*a*);

a gauge portion (17) extending from said second body (4) and defining a respective abutment surface (17*a*);

said actuator (14) being movable between a first condition corresponding to the coupling condition wherein the respective abutment surfaces (16*a*, 17*a*) are mutually associated, and a second condition corresponding to the decoupling condition wherein the abutment surface (16*a*) of the connecting portion (16) is removed from the abutment surface (17*a*) of the gauge portion (17);

said interlocking element (7) and said cavity (6) extending along a same longitudinal axis (Y) for the dimension (D) smaller than the dimension (L) of the first and second bodies (3, 4) along said lateral development direction;

characterized in that each body (3, 4) comprises a cavity (6) and an interlocking element (7) respectively arranged on the opposite sides with respect to the lateral development direction of the body (3, 4) itself; each interlocking element (7) of a respective body (3, 4) being insertable in the cavity (6) of the other body (3, 4).

2. The device according to claim 1, characterized in that said cavity (6) is formed in an annular protrusion (9) extending from said first body (3) and having in the cross-section a substantially circular conformation, coaxial to said longitudinal axis (Y).

3. The device according to claim 2, characterized in that said longitudinal axis (Y) of the annular protrusion (9) and the cylindrical protrusion (10) corresponds to the lateral development direction of the first and second bodies (3, 4) and to the sliding direction (A).

4. The device according to claim 1, characterized in that said interlocking element (7) comprises a cylindrical protrusion (10) extending from said second body (4) and having a cross-sectional conformation substantially circular, coaxial to said longitudinal axis (Y).

5. The device according to claim 4, characterized in that said interlocking element (7) further comprises an abutment portion (13) inserted between the cylindrical protrusion (10) and the connecting portion (4*a*) of the second body (4); said annular protrusion (9) being abutted to the abutment portion (13) to define a single way of the direction (A) in which the annular protrusion (9) can slide with respect to the cylindrical protrusion (10) to define the decoupling condition.

6. The device according to claim 1, characterized in that the dimensions (D) of the interlocking element (7) and of the cavity (6) of a single body (3, 4) are smaller than the size (L) of the body (3, 4) along said lateral development direction.

7. The device according to claim 1, characterized in that said actuator (14) comprises a tab (15) protruding from the coupling portion (3*a*) to be moved by manual traction and define said second condition; said connecting portion (16) being defined by a protrusion extending from said tab (15).

8. The device according to claim 1, characterized in that said tab (15) and said gauge portion (17) are inserted between the respective interlocking elements (7) and respective cavities (6).

9. A rapid release method for wearable articles comprising the following steps:

preparing a first body (3) associated to a first part (2*a*) of said article (2) which defines at least one through cavity (6);

preparing a second body (4) associated with the first body (3) and engaged with a second part (2*b*) of said article (2), and having at least one interlocking element (7) housed in said cavity (6);

manually activating the release means (8) obtained in the two bodies (3, 4) for disengaging the two bodies (3, 4) one from the other; and at the same time;

making the interlocking element (7) slide outside said cavity (6) to define a decoupling condition of the first body (3) from the second body (4);

said step of making the interlocking element (7) slide outside the cavity (6) being performed by moving the first body (3) along a respective direction (A) corresponding to the lateral development direction of the first and second bodies (3, 4) and along a section (T) smaller than the size (L) of the bodies (3, 4) along said lateral development direction; characterized in that said step of activating the release means (8) is performed by manual traction of a tab (15) on the first body (3) to deform said tab (15) and disengage a connecting portion (16) of the tab (15) from a gauge portion (17) of the second body (4).

10. The method according to claim 9, characterized in that said step of activating the release means (8) and making the interlocking element (7) slide outside the cavity (6) is performed by the same hand that grabs the tab (15) and which, when pulled, is moved along the sliding direction (A).

* * * * *